US009791811B2

(12) United States Patent
Imazu

(10) Patent No.: US 9,791,811 B2
(45) Date of Patent: Oct. 17, 2017

(54) FIXING DEVICE AND IMAGE FORMING APPARATUS

(71) Applicant: FUJI XEROX CO., LTD., Tokyo (JP)

(72) Inventor: Koichi Imazu, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/249,867

(22) Filed: Aug. 29, 2016

(65) Prior Publication Data

US 2017/0227896 A1 Aug. 10, 2017

(30) Foreign Application Priority Data

Feb. 5, 2016 (JP) ..... 2016-020652

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/323, 329
See application file for complete search history.

(56) References Cited

U.S. PATENT DOCUMENTS

2007/0048035 A1* 3/2007 Baba ..... G03G 15/2028 399/323
2009/0116885 A1* 5/2009 Ando ..... G03G 15/2028 399/329

FOREIGN PATENT DOCUMENTS

JP 2007-171690 A 7/2007
JP 4770453 B2 9/2011

* cited by examiner

*Primary Examiner* — Sandra Brase
(74) *Attorney, Agent, or Firm* — Oliff PLC

(57) ABSTRACT

A fixing device includes a belt member, a fixing member facing an outer peripheral surface of the belt member and forming a fixing nip portion between the belt member, and a separating pad portion disposed inside the belt member, including a pressing surface for pressing the fixing member at downstream of the fixing nip portion in a moving direction of the belt member and separating a recording material from the fixing member. The pressing surface of the separating pad portion curves so as to protrude toward the fixing member as approaching a central portion thereof in a rotation axis direction of the fixing member. An upstream end portion and a downstream end portion of the pressing surface curve so as to protrude toward an upstream side in the moving direction as they approach the central portion in the rotation axis direction.

5 Claims, 8 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-020652 filed Feb. 5, 2016.

BACKGROUND

Technical Field

The present invention relates to a fixing device and an image forming apparatus.

SUMMARY

According to an aspect of the invention, a fixing device includes: a belt member that moves in a circulating manner, a fixing member that faces an outer peripheral surface of the belt member and rotates, wherein the belt member and the fixing member form a fixing nip portion therebetween in which an image is fixed to a recording material; and a separating pad portion that is disposed on an inner periphery of the belt member and includes a pressing surface which presses the fixing member at downstream of the fixing nip portion in a moving direction of the belt member, the separating pad portion being configured to separate the recording material from the fixing member, wherein the pressing surface of the separating pad portion curves so as to protrude toward the fixing member as it approaches a central portion thereof in a rotation axis direction of the fixing member from both end portions thereof in the rotation axis direction, wherein the pressing surface of the separating pad portion includes an upstream end portion and a downstream end portion in the moving direction, and wherein the upstream end portion and the downstream end portion curve so as to protrude toward an upstream side in the moving direction as they approach the central portion in the rotation axis direction from the both end portions in the rotation axis direction.

BRIEF DESCRIPTION OF THE DRAWINGS

Exemplary embodiments of the present invention will be described in detail based on the following figures, wherein.

DETAILED DESCRIPTION

Hereinafter, with reference to drawings, an exemplary embodiment of the invention will be described in detail.

Figure 1:
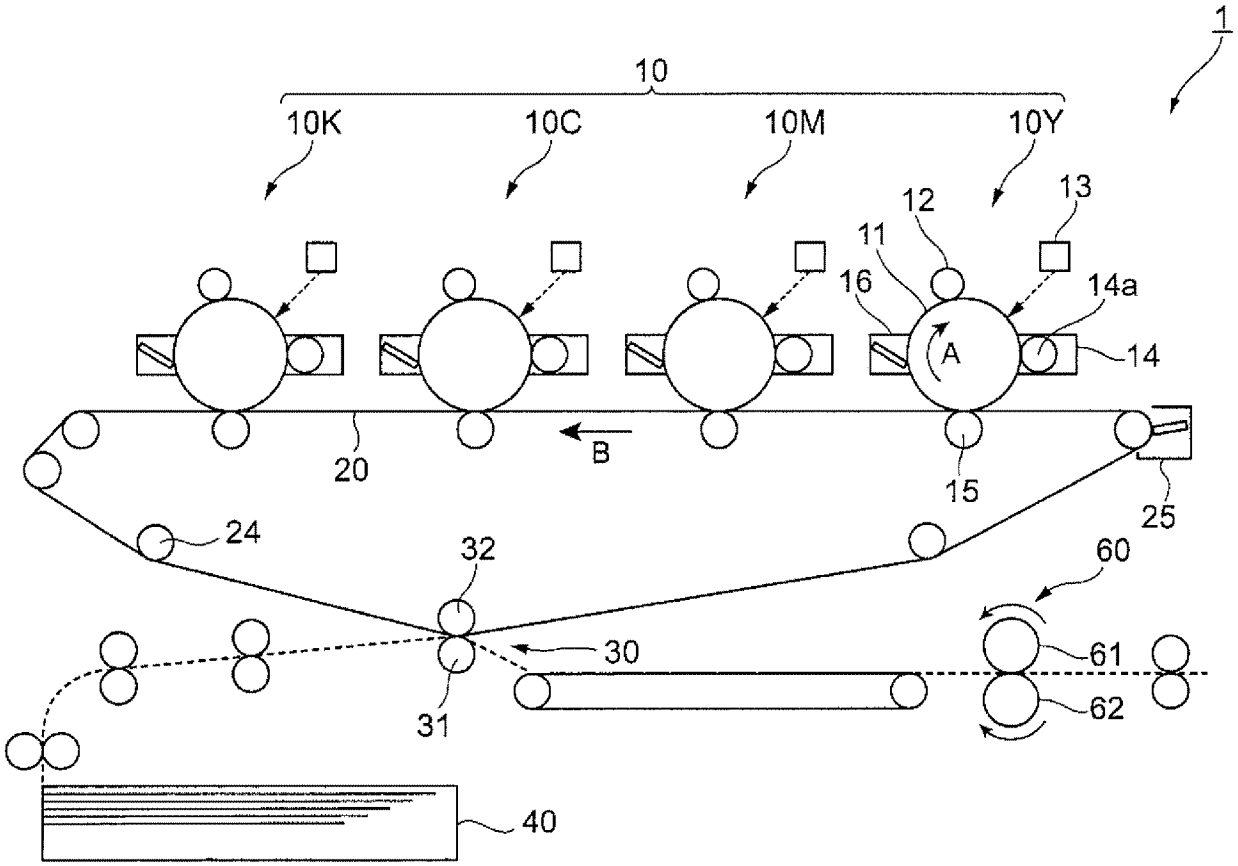
FIG. 1 is a diagram illustrating an entire configuration of an image forming apparatus to which an exemplary embodiment is applied.

FIG. 1 is a diagram illustrating an entire configuration of an image forming apparatus 1 to which the exemplary embodiment is applied.

The image forming apparatus 1, for example, includes plural (four in the exemplary embodiment) image forming units 10 (specifically 10Y, 10M, 10C and 10K) as an example of an image forming section that forms each color toner image by an electrophotographic process, an intermediate transfer belt 20 that transfers (primarily transfers) each color toner image formed in each image forming unit 10 and holds, a secondary transfer device 30 that secondarily transfers a primarily transferred superimposed toner image on the intermediate transfer belt 20 to a sheet as an example of a recording material, a sheet holding portion 40 that holds the sheet supplied to the secondary transfer device 30, and a fixing device 60 that fixes a secondarily transferred image on the sheet.

Each image forming unit 10, that is, an image forming unit 10Y of yellow (Y), an image forming unit 10M of magenta (M), an image forming unit 10C of cyan (C) and an image forming unit 10K of black (K) includes a common configuration, except for a toner color used.

Each of the image forming units 10 is provided with a photoconductor drum 11 that is disposed to be rotatable in a direction of arrow A. Each of the image forming units 10 includes a charging unit 12, an exposure unit 13, a developing unit 14, a primary transfer roll 15 and a drum cleaner 16 that are disposed along the direction of arrow A in the vicinity of the photoconductor drum 11.

The intermediate transfer belt 20 is rotatably bridged to plural supporting rolls (six in the exemplary embodiment). A belt cleaner 25 that cleans a front surface of the intermediate transfer belt 20 before entering a portion opposed to the photoconductor drum 11 of the image forming unit 10 after passing through the secondary transfer device 30 is disposed on a front surface of the intermediate transfer belt 20.

The secondary transfer device 30 is provided with a secondary transfer roll 31 disposed in contact with the toner image transfer surface of the intermediate transfer belt 20 and a backup roll 32 which is disposed on a back surface of the intermediate transfer belt 20 and forms a counter electrode of the secondary transfer roll 31.

The fixing device 60 is provided with a fixing roll 61 that heats the sheet transported to the fixing device 60 and a pressure module 62 that pressurizes the fixing roll 61. In addition, the configuration of the fixing device 60 will be described in detail in the following paragraph.

An image forming process by a following process is performed under an operation control by a controller (not illustrated) in the image forming apparatus 1 of the exemplary embodiment. That is, image data received from a PC or a scanner becomes color image data and is sent to each image forming unit 10 after predetermined image processing is performed. For example, in the image forming unit 10Y that forms the yellow (Y) toner image, the photoconductor drum 11 is charged at a predetermined potential by the charging unit 12 while rotating in the direction of the arrow A, and the exposure unit 13 exposes the photoconductor drum 11, based on the transmitted image data of yellow (Y). Thereby, an electrostatic latent image relating to the yellow (Y) image is formed on the photoconductor drum 11. The yellow (Y) electrostatic latent image formed on the photoconductor drum 11 is developed by the developing unit 14, and the yellow (Y) toner image is formed on the photoconductor drum 11. Similarly, each color toner image of magenta (M), cyan (C), and black (K) is formed in the image forming units 10M, 10C, and 10K.

Each color toner image formed in the photoconductor drum 11 of each image forming unit 10 is successively electrostatically transferred (primarily transferred) onto the intermediate transfer belt 20 that moves in the direction of the arrow B by the primary transfer roll 15, and a superimposed toner image in which each color toner is superimposed is formed. The superimposed toner image on the intermediate transfer belt 20 is transported to the secondary transfer device 30 with movement of the intermediate transfer belt 20. When the superimposed toner image is transported to the secondary transfer device 30, a sheet P is supplied to the secondary transfer device 30 from the sheet holding portion 40 in accordance with timing thereof. The superimposed toner image is electrostatically transferred (secondarily transferred) collectively on the transported sheet P by a transfer electric field that the secondary transfer roll 31 forms in the secondary transfer device.

And then, the sheet P in which the superimposed toner image is electrostatically transferred is transported to the fixing device 60. The toner image on the sheet P transported to the fixing device 60 receives heat and pressure by the fixing device 60, and is fixed on the sheet P. The sheet P on which a fixed image is formed is discharged to the outside of the image forming apparatus 1.

On the other hand, the toner (primary transfer residual toner) attached to the photoconductor drum 11 after the primary transfer and the toner (secondary transfer residual toner) attached to the intermediate transfer belt 20 after the secondary transfer are respectively removed by the drum cleaner 16 and the belt cleaner 25.

In this manner, the image forming process in the image forming apparatus 1 is repeatedly performed by only a cycle of the printed number of sheets.

Figure 2:
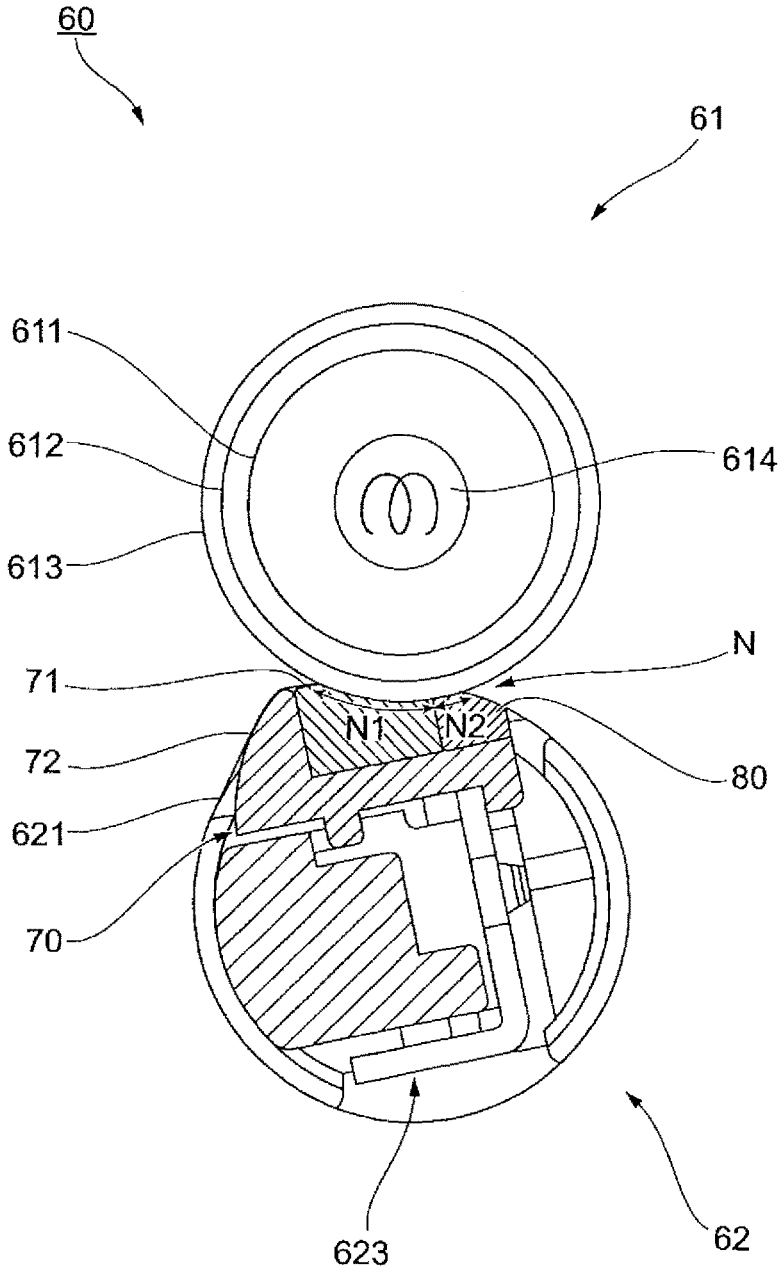
FIG. 2 is a diagram illustrating a fixing device to which the exemplary embodiment is applied.

Subsequently, the configuration of the fixing device 60 according to the exemplary embodiment will be described. FIG. 2 is a diagram illustrating the fixing device 60 to which the exemplary embodiment is applied, and is a sectional view of the fixing device 60 taken along the plane perpendicular to an axial direction (described later) of the fixing roll 61.

As illustrated in FIG. 2, the fixing device 60 according to the exemplary embodiment is provided with the fixing roll 61 as an example of a fixing member that heats the sheet transported to the fixing device 60 and the pressure module 62 that pressurizes the fixing roll 61 and forms a nip portion N between the pressure module 62 and the fixing roll 61.

When a fixing operation is performed, the fixing roll 61 is rotated in a counterclockwise direction in the figure by a driving unit (not illustrated), and a pressure belt 621 (described later) of the pressure module 62 is rotated in a clockwise direction in the figure by being driven by the rotation of the fixing roll, in the fixing device 60 according to the exemplary embodiment. Thereby, the sheet is transported from the left side to the right side in the figure, and the image is fixed on the sheet in the nip portion N.

The fixing roll 61 and the pressure module 62 are pressed (pressurized) by an elastic body (not illustrated) disposed at the both end portions of the direction along a rotation shaft of the fixing roll 61 and the pressure module 62 in the fixing device 60 according to the exemplary embodiment. Thereby, the nip portion N is formed between the fixing roll 61 and the pressure module 62 in the fixing device 60.

In the following description, a direction along the rotation shaft of the fixing roll 61 (direction perpendicular to the sheet of FIG. 2) may be simply referred to as an "axial direction (rotation axis direction)", a transport direction of the sheet in the nip portion N (direction from left side to right side in FIG. 2) may be simply referred to as a "transport direction (moving direction of a belt member)", and a pressurizing direction by the pressure module 62 (direction from the pressure module 62 toward the fixing roll 61, direction from a lower side toward an upper side in FIG. 2) may be simply referred to as a "pressurizing direction".

The fixing roll 61 is provided with a cylindrical base body 611, a heat resistant elastic layer 612 formed on an outer periphery of the base body 611 and a release layer 613 formed on the front surface of the heat resistant elastic layer 612. The fixing roll 61 is provided with a halogen heater 614 that is disposed on the inner side of the base body 611 and functions as a heat source.

The base body 611, for example, is made of a metal having a high thermal conductivity such as iron, aluminum, and SUS.

The heat resistant elastic layer 612 is made of an elastic member having high heat resistance. Examples of the material constituting the heat resistant elastic layer 612, for example, include a silicone rubber, a fluororubber, and the like, although the material is not particularly limited thereto.

The release layer 613 is made of a heat resistant resin. Examples of the material constituting the release layer 613, for example, include a PFA resin, a PTFE resin, a fluororesin, a silicone resin, a fluorosilicone rubber, a silicone rubber, and the like, although the material is not particularly limited thereto. Among these, the fluororesin is suitable to use as the material, from a viewpoint of a releasing property or a wear resistance of the toner.

The pressure module 62 is provided with the pressure belt 621 as an example of the belt member that is disposed in contact with an outer peripheral surface of the fixing roll 61 and forms the nip portion N between the pressure module 62 and the fixing roll 61. The pressure module 62 is provided with a pad member 70 that is disposed on the inner side of the pressure belt 621 and presses the fixing roll 61 via the pressure belt 621. Furthermore, the pressure module 62 is provided with a support member 623 that supports the pad member 70 and regulates a shape of the pressure belt 621.

The pressure belt 621 includes an endless belt member of which an original form, for example, is a cylindrical shape. The pressure belt 621 is configured such that a base layer including a sheet-shaped member having a high heat resistance, an elastic layer stacked on the base layer and a front surface layer that is stacked on the elastic layer and is exposed on an outer peripheral surface of the pressure belt 621 are stacked in order from an inner peripheral surface side of the pressure belt 621.

As the base layer, a flexible material having excellent mechanical strength and heat resistance is used. Examples of the material constituting the base layer, for example, include a fluororesin, a polyimide resin, a polyamide resin, a polyamide-imide resin, a polyether ether ketone (PEEK) resin, a polyethersulfone (PES) resin, a polyphenylene sulfide (PPS) resin, a PFA resin, a polytetrafluoroethylene (PTFE) resin, a tetrafluoroethylene hexafluoropropylene copolymer (FEP) resin, and the like.

As the elastic layer, a rubber having excellent heat resistance, and excellent thermal conductivity such as a silicone rubber, a fluororubber, a fluorosilicone rubber, and the like is used.

As the front surface release layer, for example, a PFA resin, a PTFE resin, a fluororesin, a silicone resin, a fluorosilicone rubber, a silicone rubber, and the like are used.

The support member 623 is disposed along the axial direction on an inner periphery of the pressure belt 621. The support member 623 supports the pad member 70 at a position where the fixing roll 61 and the pressure belt 621 are opposed to each other, and causes the pad member 70 to be pressed to the fixing roll 61 via the pressure belt 621. Thereby, the nip portion N is formed between the fixing roll 61 and the pressure belt 621.

The support member 623, for example, is made of a heat resistant resin, a metal, or the like.

The pad member 70, as illustrated in FIG. 2, is disposed in a state opposed to the fixing roll 61 on the inner periphery side of the pressure belt 621, and functions so as to form the nip portion N between the fixing roll 61 and the pressure belt 621. The pad member 70, as illustrated in FIG. 2, is provided with a pre-nip portion 71 that forms a pre-nip region N1 for ensuring the nip portion N of which a length in the transport direction is long. Furthermore, the pad member 70 is provided with a separating pad portion 80 that is disposed adjacent to the pre-nip portion 71 on a downstream side in the transport direction, and forms a separating nip region N2 which causes the sheet to be separated from the fixing roll 61 by applying distortion to the fixing roll 61. Furthermore, the pad member 70 is provided with a holding portion 72 that holds the pre-nip portion 71 and regulates the shape of the pressure belt 621 which enters the nip portion N at the position adjacent to the pre-nip portion 71 on an upstream side in the transport direction.

In addition, although not illustrated in the drawing, in the pad member 70, a low friction sheet for reducing frictional resistance with respect to the inner peripheral surface of the pressure belt 621 may be provided on the surface opposed to the pressure belt 621 in the pre-nip portion 71 and the separating pad portion 80.

The pre-nip portion 71 is configured with an elastic material such as a silicone rubber and a fluororubber, a leaf spring, or the like. A surface of the pre-nip portion 71 opposed to the fixing roll 61 via the pressure belt 621 is formed with a concave shape so as to follow the outer peripheral surface of the fixing roll 61.

The separating pad portion 80 and the holding portion 72, for example, are made of a resin having heat resistance such as a polyphenylene sulfide (PPS), a polyester, and a polyamide or a metal such as iron, aluminum, and SUS. In addition, in this example, although the separating pad portion 80 and the holding portion 72 are integrated with each other, these portions may be disposed as a separate body. The materials constituting the separating pad portion 80 and the holding portion 72 may be the same or may be different.

Figure 3:
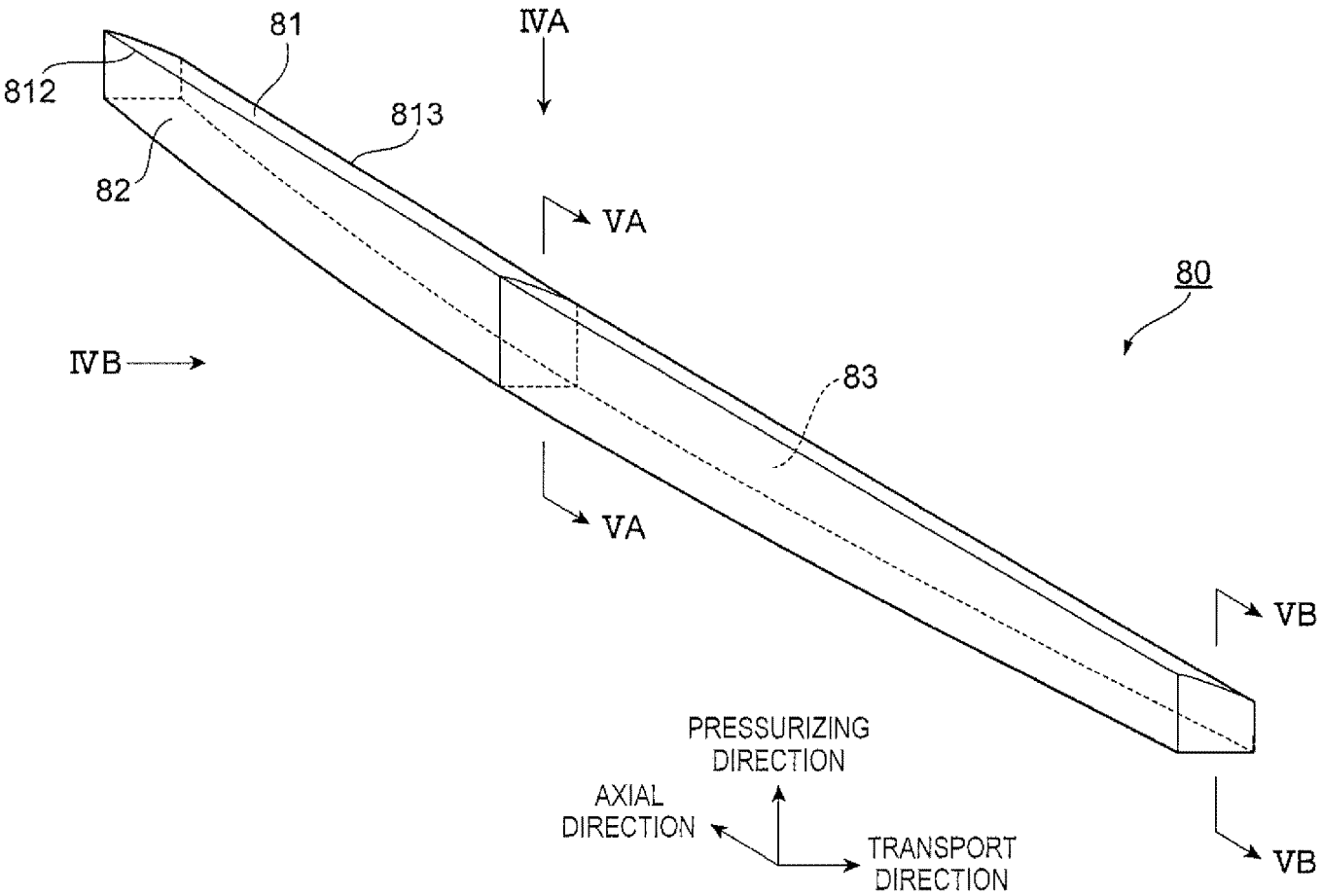
FIG. 3 is a diagram to describe a shape of a separating pad portion to which the exemplary embodiment is applied.
Figure 4A:
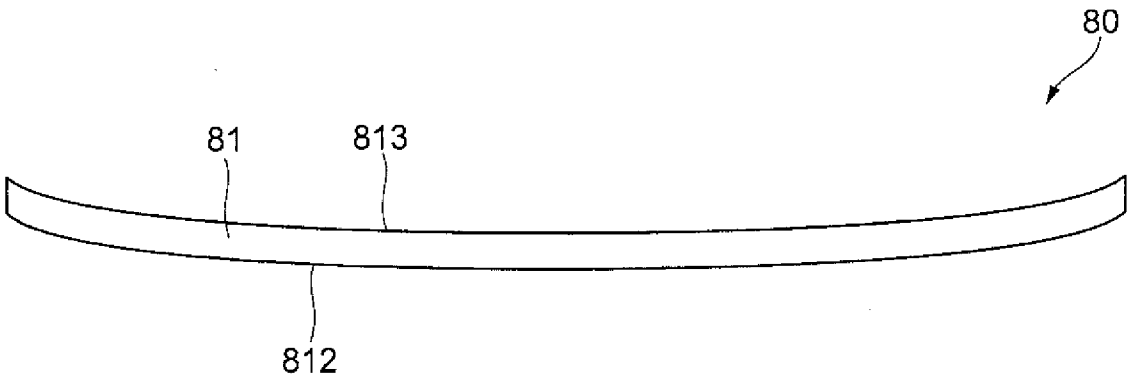
FIGS. 4A and 4B are diagrams to describe the shape of the separating pad portion to which the exemplary embodiment is applied.
Figure 4B:
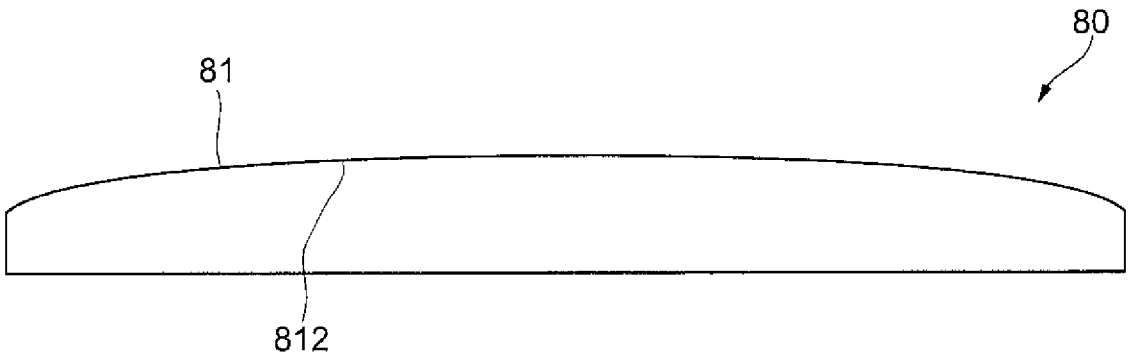
Figure 5B:
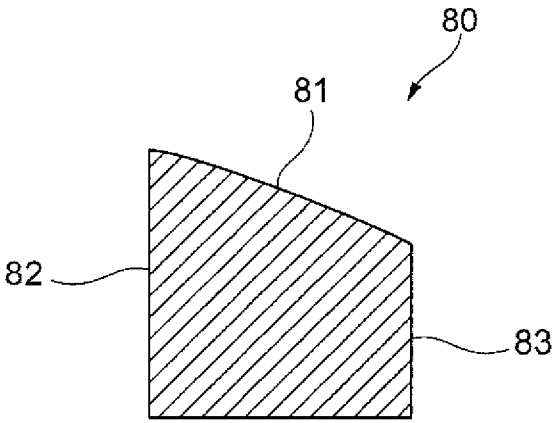
FIGS. 5A and 5B are diagrams to describe the shape of the separating pad portion to which the exemplary embodiment is applied.
Figure 5A:
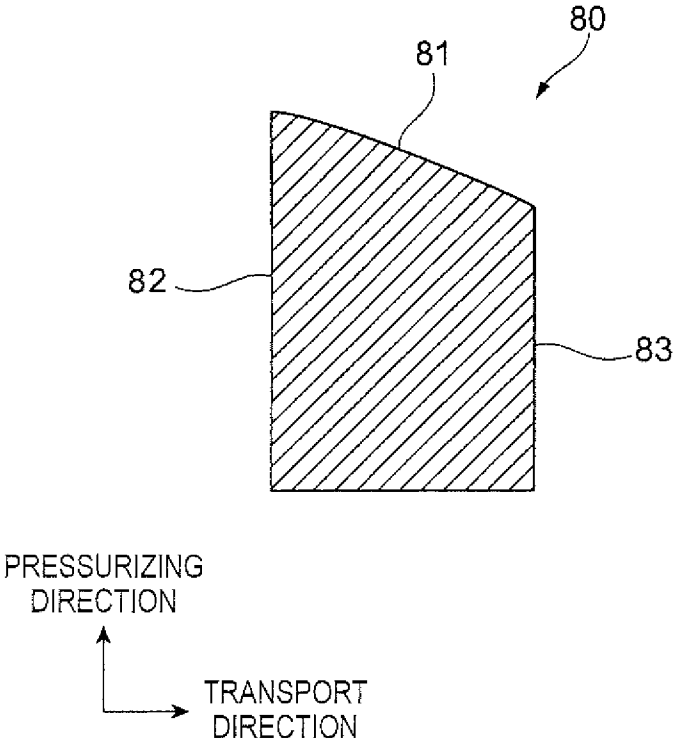

Subsequently, the shape of the separating pad portion 80 in the pad member 70 according to the exemplary embodiment will be described in detail. FIG. 3, FIGS. 4A and 4B, and FIGS. 5A and 5B are diagrams to describe the shape of the separating pad portion 80 to which the exemplary embodiment is applied. FIG. 3 is a perspective view of the separating pad portion 80. FIG. 4A illustrates the separating pad portion 80 of FIG. 3 when the separating pad portion 80 is viewed from an IVA direction, and FIG. 4B illustrates the separating pad portion 80 of FIG. 3 when the separating pad portion 80 is viewed from an IVB direction. Furthermore, FIG. 5A is a cross-sectional view taken along line VA-VA of the separating pad portion 80 illustrated in FIG. 3 and FIG. 5B is a cross-sectional view taken along line VB-VB of the separating pad portion 80 illustrated in FIG. 3.

As illustrated in FIG. 3, the separating pad portion 80 according to the exemplary embodiment includes an elongated shape extending along the axial direction. The separating pad portion 80 according to the exemplary embodiment includes a symmetrical shape at one end portion side (upstream side in the axial direction) and the other end portion side (downstream side in the axial direction) with respect to a center in the axial direction.

As illustrated in FIG. 2 and FIG. 3, the separating pad portion 80 includes a pressing surface 81 that extends along the axial direction, presses the fixing roll 61 via the pressure belt 621 in a state where the pad member 70 is disposed on the inner periphery of the pressure belt 621, and forms the separating nip region N2. The separating pad portion 80 is provided with an upstream side surface 82 that extends along the pressurizing direction from the end portion of the pressing surface 81 on the upstream side in the transport direction, and a downstream side surface 83 that extends along the pressurizing direction from the end portion of the pressing surface 81 on the downstream side.

Here, a boundary between the upstream side surface 82 and the pressing surface 81 is referred to as an upstream end portion 812, and a boundary between the downstream side surface 83 and the pressing surface 81 is referred to as a downstream end portion 813.

FIG. 3 and FIG. 4A, in the separating pad portion 80 according to the exemplary embodiment, the upstream side surface 82 includes a curved shape so as to be convex toward the upstream side in the transport direction as it approaches a central portion in the axial direction from the both end portions in the axial direction. Thereby, when the separating pad portion 80 according to the exemplary embodiment is viewed from the pressurizing direction, the upstream end portion 812 curves so as to protrude toward the upstream side in the transport direction as it approaches the central portion in the axial direction from the both end portions in the axial direction.

The upstream side surface 82 and the upstream end portion 812 of the separating pad portion 80 include such a shape, so that an entrance of the separating nip region N2 (refer to FIG. 2) that is formed between the pressing surface 81 of the separating pad portion 80 and the fixing roll 61 (refer to FIG. 2) via the pressure belt 621 (refer to FIG. 2) is positioned on the upstream side in the transport direction as the central portion in the axial direction in comparison with the both end portions in the axial direction.

Thereby, in a case where the fixing operation is performed by the fixing device 60 (refer to FIG. 2), firstly the central portion in the axial direction of the sheet after passing through the pre-nip region N1 (refer to FIG. 2) reaches the separating nip region N2. After the central portion in the axial direction of the sheet enters the separating nip region N2, the both end portions in the axial direction of the sheet enter the separating nip region N2.

By adopting this configuration, a force directed from the central portion in the axial direction toward the both end portions in the axial direction is applied to the sheet passing through the separating nip region N2. In other words, the sheet passing through the separating nip region N2 is drawn toward both end portions from the central portion in the axial direction. As a result, for example, in comparison with a case where the upstream side surface 82 and the upstream end portion 812 are flat over the central portion from the both end portions in the axial direction, it is suppressed that wrinkle on the sheet after passing through the fixing device 60 is generated.

As illustrated in FIG. 3 and FIG. 4A, in the separating pad portion 80 according to the exemplary embodiment, the downstream side surface 83 includes a curved shape so as to be concave toward the downstream side in the transport direction as it approaches the central portion in the axial direction from the both end portions in the axial direction. Thereby, when the separating pad portion 80 according to the exemplary embodiment is viewed from the pressurizing direction, the downstream end portion 813 curves so as to protrude to the upstream side in the transport direction as it approaches the central portion in the axial direction from the both end portions in the axial direction.

Furthermore, as illustrated in FIG. 4A, the downstream side surface 83 is disposed substantially parallel to the upstream side surface 82. Thereby, when the separating pad portion 80 is viewed from the downstream side of the pressurizing direction, the upstream end portion 812 and the downstream end portion 813 are substantially parallel to each other.

As illustrated in FIG. 3 and FIG. 4B, in the separating pad portion 80 according to the exemplary embodiment, the pressing surface 81 includes a curved shape so as to protrude to the downstream side (fixing roll 61 (refer to FIG. 2) side) in the pressurizing direction as it approaches the central portion in the axial direction from the both end portions in the axial direction. Thereby, when the separating pad portion 80 is viewed from the transport direction, the upstream end portion 812 and the downstream end portion 813 curve so as to protrude to the downstream side in the pressurizing direction as they approach the central portion in the axial direction from the both end portions in the axial direction.

Here, in the fixing device 60 (refer to FIG. 2) according to the exemplary embodiment, as described above, the fixing roll 61 and the pressure module 62 are pressed by the elastic body (not illustrated) disposed on the both end portions in the axial direction. For this reason, in a state where the fixing roll 61 and the pressure module 62 are pressed, bending on the fixing roll 61 so as to protrude to the pressure module 62 side as the both end portions in the axial direction occurs. In other words, in the fixing device 60, at the nip portion N, the front surface of the fixing roll 61 bends so as to be concave toward the upstream side in the pressurizing direction as it approaches the central portion in the axial direction from the both end portions in the axial direction.

On the other hand, in the exemplary embodiment, even in a case where the fixing roll 61 bends, the pressing surface 81 of the separating pad portion 80 becomes the curved shape so as to protrude to the downstream side in the pressurizing direction as it approaches the central portion in the axial direction from the both end portions in the axial direction. Therefore, for example, contact failure or decrease of the pressing force between the pressure module 62 and the fixing roll 61 on the central portion in the axial direction is suppressed.

Thereby, for example, in comparison with a case where the pressing surface 81 is flat over the central portion from the both end portions in the axial direction, it is suppressed that difference of the pressing force between the both end portions in the axial direction of the separating nip region N2 and the central portion is generated.

Furthermore, as illustrated in FIG. 3 and FIG. 4A, when the pressing surface 81 is viewed from the downstream side (fixing roll 61 side) in the pressurizing direction, the pressing surface 81 as a whole has such a shape that the central portion in the axial direction is warped to a arched shape protruding to the upstream side in the transport direction.

When the pressing surface 81 is viewed from the downstream side in the pressurizing direction, the distance between the upstream end portion 812 and the downstream end portion 813 takes the same value from one end to the other end of the pressing surface 81 in the axial direction. In other words, the separating pad portion 80 according to the exemplary embodiment has the same distance between the upstream end portion 812 and the downstream end portion 813, at the both end portions and the central portion in the axial direction.

In the separating pad portion 80 according to the exemplary embodiment, as illustrated in FIGS. 5A and 5B, cross-section shapes of the pressing surface 81 taken at the both end portions and the central portion in the axial direction along the plane perpendicular to the axial direction are similar to each other.

Thereby, in the fixing device 60 according to the exemplary embodiment, the shape of the separating nip region N2 the both end portions in the axial direction is same between the both end portions in the axial direction and the central portion in the nip portion N that is formed between the fixing roll 61 and the pressure module 62.

Since the shapes of the separating nip region N2 are same, for example, in comparison with a case where the shape of the separating nip region N2 of the both end portions in the axial direction is different from the shape of the central portion, the difference of the pressing force, which is generated between the separating pad portion 80 and the fixing roll 61 via the pressure belt 621, between the both end portions in the axial direction and the central portion is reduced. In other words, the difference of the pressing force, which is applied on the front surface of the fixing roll 61 in the separating nip region N2, between the both end portions in the axial direction and the central portion in the axial direction is reduced.

Thereby, in the fixing device 60 according to the exemplary embodiment, a performance of separating the sheet is maintained in both of the both end portions and the central portion in the axial direction and separating failure of the sheet is suppressed.

On the other hand, in a case where the cross-section shape of the pressing surface 81 of the separating pad portion 80 taken at the both end portions in the axial direction along the plane perpendicular to the axial direction is different from the cross-section shape thereof taken at the central portion in the axial direction along the plane perpendicular to the axial direction, for example, the separating failure of the sheet tends to be likely to occur on the central portion in the axial direction.

EXAMPLE

Hereinafter, the effect according to the exemplary embodiment of the invention will be described in detail, by using an example and a comparative example.

Example

By using the image forming apparatus 1 that includes the fixing device 60 provided with the separating pad portion 80 having the shape illustrated in FIG. 3, FIGS. 4A and 4B, and FIGS. 5A and 5B, the image-forming is performed on a sheet under a condition illustrated in Table 1 below, and evaluation for a separating property of the sheet in the fixing device 60 is performed.

The evaluation for the separating property is performed under the condition of temperature of 28 degrees and humidity of 85%. P sheet is used as the sheet and the image-forming by the image forming apparatus 1 is performed so that a margin of 4 mm is formed in each of the four sides of the sheet. In addition, an image density in Table 1 represents the image density in the end portion of the downstream side in transport direction of the sheet (leading end of the sheet) in the image forming apparatus 1.

The evaluation for the separating property of the sheet in the fixing device 60 is performed under following criteria.

A: There is no problem in the separating of the sheet.

B: Although damage occurs without the leading end of the sheet being completely separated, paper jam does not occur.

C: The paper jam occurs without the sheet being separated.

Comparative Example

Figure 6:
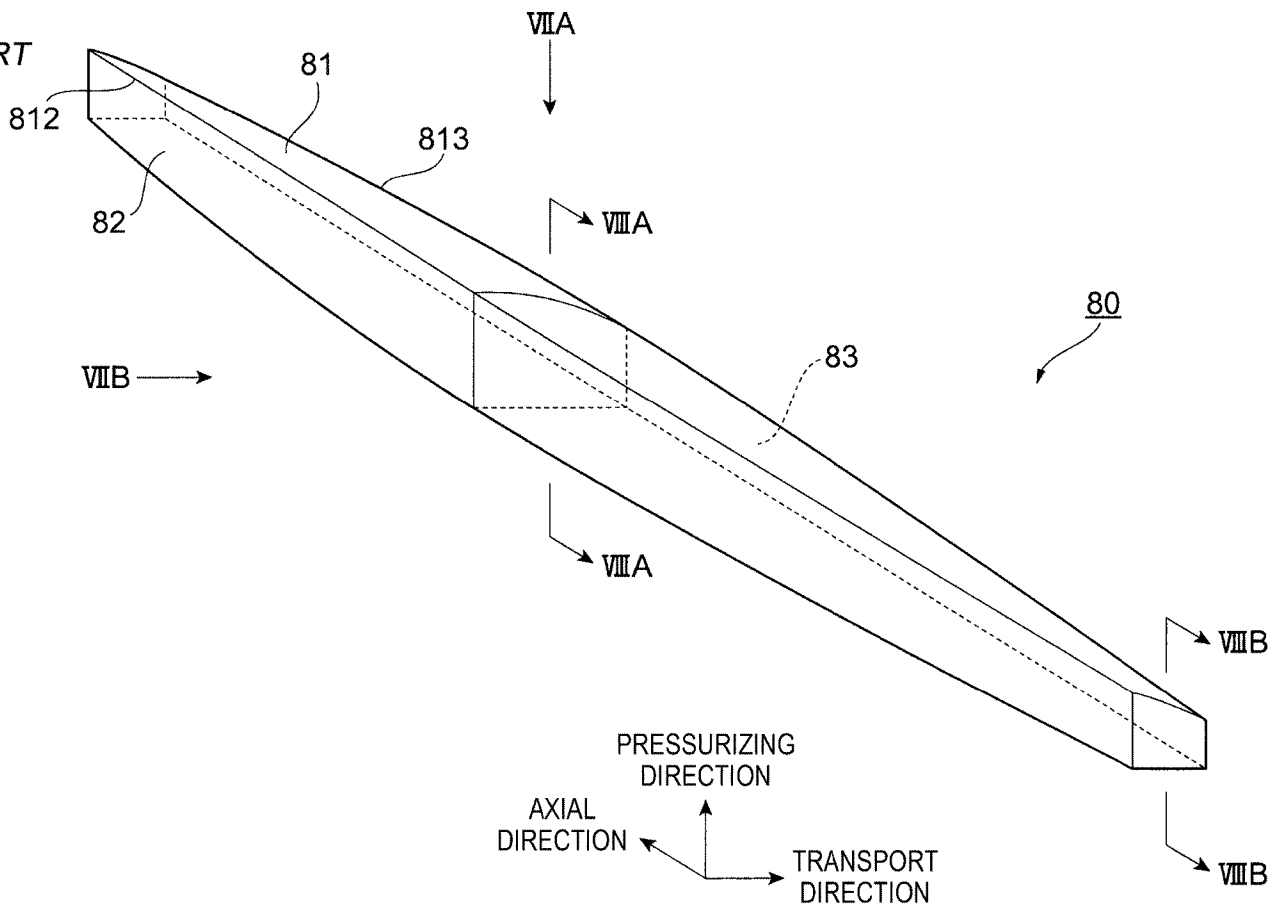
FIG. 6 RELATED ART
FIG. 6 is a diagram illustrating a shape of a separating pad portion according to the related art.
Figure 7A:
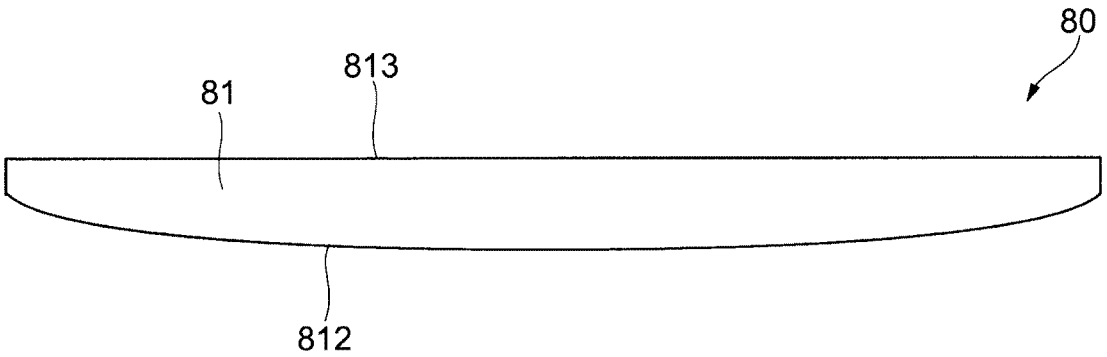
FIG. 7A RELATED ART
FIGS. 7A and 7B are diagrams illustrating the shape of the separating pad portion according to the related art.
Figure 7B:
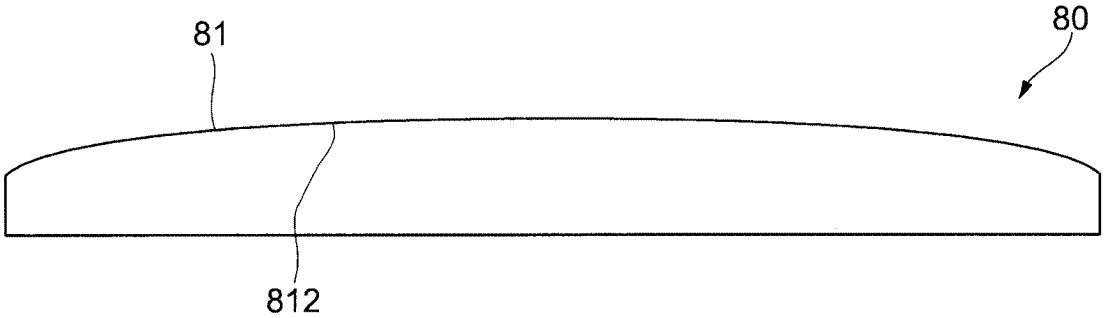
FIG. 7B RELATED ART
Figure 8B:
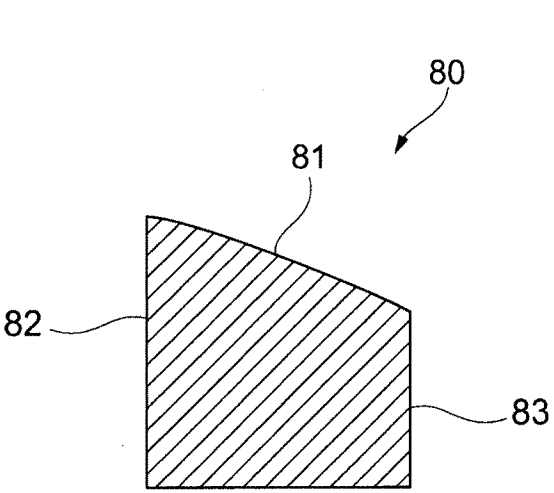
FIG. 8B RELATED ART
FIGS. 8A and 8B are diagrams illustrating the shape of the separating pad portion according to the related art.
Figure 8A:
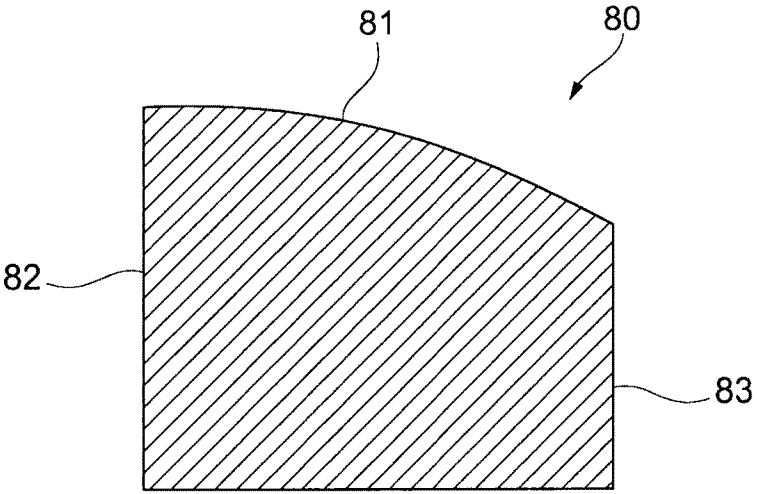
FIG. 8A RELATED ART

FIG. 6, FIGS. 7A and 7B, and FIGS. 8A and 8B are the diagrams illustrating the shape of the separating pad portion 80 according to the related art. FIG. 6 is a perspective view of the separating pad portion 80 according to the related art. FIG. 7A illustrates the separating pad portion 80 of FIG. 6 viewed when the separating pad portion 80 is viewed from a VIIA direction, and FIG. 7B illustrates the separating pad portion 80 of FIG. 6 when the separating pad portion 80 is viewed from a VIIB direction. Furthermore, FIG. 8A is a cross-sectional view taken along line VIIIA-VIIIA of the separating pad portion 80 illustrated in FIG. 6 and FIG. 8B is a cross-sectional view taken along line VIIB-VIIIB of the separating pad portion 80 illustrated in FIG. 6. In addition, in FIG. 6, FIGS. 7A and 7B, and FIGS. 8A and 8B, the same reference numerals are used to the same configuration as the separating pad portion 80 according to the exemplary embodiment illustrated in FIG. 3, FIGS. 4A and 4B, and FIGS. 5A and 5B, and the detailed description will be omitted here.

In the separating pad portion 80 according to the related art illustrated in FIG. 6, FIGS. 7A and 7B, and FIGS. 8A and 8B, in comparison with the separating pad portion 80 according to the exemplary embodiment illustrated in FIG. 3, FIGS. 4A and 4B, and FIGS. 5A and 5B, the shapes of the pressing surface 81, the downstream side surface 83 and the downstream end portion 813 are different from each other.

Specifically, in the separating pad portion 80 according to the related art, as illustrated in FIG. 6 and FIG. 7A, the downstream side surface 83 includes the flat shape over the central portion in the axial direction from the both end portions in the axial direction. In other words, in the separating pad portion 80 according to the related art, the downstream side surface 83 is configured to be a flat surface. Thereby, when the separating pad portion 80 according to the related art is viewed from the pressurizing direction, the downstream end portion 813 has a linear shape extending along the axial direction.

Furthermore, in the separating pad portion 80 according to the related art, as illustrated in FIG. 6 and FIG. 7B, when the pressing surface 81 is viewed from the downstream side (fixing roll 61 side) in the pressurizing direction, the distance from the upstream end portion 812 to the downstream end portion 813 gets longer from the both end portions in the axial direction toward the central portion in the axial direction. In other words, in the separating pad portion 80 according to the related art, the distance from the upstream end portion 812 to the downstream end portion 813 in the pressing surface 81 becomes longer at the central portion in the axial direction in comparison with the both end portions in the axial direction.

In the comparative example the image-forming is performed on the sheet in the same manner as the example, except for using the separating pad portion 80 according to the related art that includes the shape illustrated in FIG. 6, FIGS. 7A and 7B, and FIGS. 8A and 8B, and the evaluation for the separating property of the sheet in the fixing device 60 is performed.

Evaluation Result

The evaluation result for the separating property of the sheet in the fixing device 60 of the example and the comparative example is illustrated in Table 1 below.

TABLE 1

| Condition | | | Separating property evaluation | |
|---|---|---|---|---|
| Sheet | | | | |
| Moisture content | Size | Image density | Example | Comparative example |
| 7~8% | A4 | <10% | A | A |
| | (Lateral | 150% | A | A |
| | feeding) | 200% | A | B |
| | A3 | <10% | A | A |
| | (Vertical | 150% | A | A |
| | feeding) | 200% | A | A |
| 9~11% | A4 | <10% | A | A |
| | (Lateral | 150% | A | C |
| | feeding) | 200% | A | C |
| | A3 | <10% | A | A |
| | (Vertical | 150% | A | B |
| | feeding) | 200% | A | C |

As illustrated in Table 1, it is confirmed that the separating property of the sheet is poor in the comparative example in comparison with the example. Specifically, it is confirmed that the image density on the sheet is high, and the separating property of the sheet is decreased as moisture content of the sheet is high in the comparative example.

It is conceivable that this result is due to the following reasons.

That is, as described above, in the separating pad portion 80 according to the related art, the distance from the upstream end portion 812 to the downstream end portion 813 in the pressing surface 81 becomes longer at the central portion in the axial direction in comparison with the both end portions in the axial direction. For this reason, in the fixing device 60 using the separating pad portion 80 according to the related art, the length of the transport direction of the separating nip region N2 at the central portion in the axial direction becomes longer in comparison with the length of the both end portions in the axial direction.

Here, in a case where the pressing force generated between the separating pad portion 80 and the fixing roll 61 on the separating nip region N2 is same, the pressure per unit area applied on the front surface of the fixing roll 61 on the separating nip region N2 tends to become weaker as the length of the separating nip region N2 becomes longer.

Thereby, in the fixing device 60 using the separating pad portion 80 according to the related art, the pressure applied to the fixing roll 61 is likely to be weak and the distortion generated on the front surface of the fixing roll 61 is likely to be decreased at the central portion in the axial direction, in comparison with the both end portions in the axial direction. For this reason, in the fixing device 60 using the separating pad portion 80 according to the related art, the separating failure of the sheet tends to be likely to occur at the central portion in the axial direction.

Accordingly, in the comparative example using the separating pad portion 80 according to the related art, it is conceivable that the separating failure of the sheet occurs on the sheet of which the image density is high or the moisture content is high, and which easily adheres to the front surface of the fixing roll 61.

On the other hand, in the example using the separating pad portion 80 according to the exemplary embodiment, regardless of the size of the sheet, the image density and the moisture content, it is confirmed that the separating property of the sheet is good in comparison with the comparative example.

The reasons are presumed as follows. That is, as described above, in the separating pad portion 80 according to the exemplary embodiment, since the cross-section shape of the pressing surface 81 taken at the both end portions and the central portion in the axial direction along the plane perpendicular to the axial direction is similar to each other. Thus, distortion suitable for separating the sheet occurs on the front surface of the fixing roll 61 at both of the both end portions and the central portion in the axial direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member that moves in a circulating manner;

a fixing member that faces an outer peripheral surface of the belt member and rotates, wherein the belt member and the fixing member form a fixing nip portion therebetween in which an image is fixed to a recording material; and a separating pad portion that is disposed on an inner periphery of the belt member and includes a pressing surface which presses the fixing member at downstream of the fixing nip portion in a moving direction of the belt member, the separating pad portion being configured to separate the recording material from the fixing member, wherein the pressing surface of the separating pad portion curves so as to protrude toward the fixing member as approaching a central portion thereof in a rotation axis direction of the fixing member from both end portions thereof in the rotation axis direction, wherein the pressing surface of the separating pad portion includes an upstream end portion and a downstream end portion in the moving direction, and wherein the upstream end portion and the downstream end portion curve so as to protrude toward an upstream side in the moving direction as approaching the central portion in the rotation axis direction from the both end portions in the rotation axis direction.

2. The fixing device according to claim 1, wherein cross-section shapes of the pressing surface taken at the both end portions and at the central portion in the rotation axis direction along a plane perpendicular to the rotation axis direction are similar to one another.

3. The fixing device according to claim 2, wherein a distance between the upstream end portion and the downstream end portion is substantially the same over a width of the pressing surface in the rotation axis direction.

4. The fixing device according to claim 1, wherein a distance between the upstream end portion and the downstream end portion is substantially the same over a width of the pressing surface in the rotation axis direction.

5. An image forming apparatus comprising:

an image forming unit that forms an image on a recording material;

a belt member that moves in a circulating manner;

a fixing member that faces an outer peripheral surface of the belt member and rotates, wherein the belt member and the fixing member form a fixing nip portion therebetween in which the image formed on the recording material is fixed to a recording material; and a separating pad portion that is disposed on an inner periphery of the belt member and includes a pressing surface which presses the fixing member at downstream of the fixing nip portion in a moving direction of the belt member, the separating pad portion being configured to separate the recording material from the fixing member, wherein the pressing surface of the separating pad portion curves so as to protrude toward the fixing member as approaching a central portion thereof in a rotation axis direction of the fixing member from both end portions thereof in the rotation axis direction, wherein the pressing surface of the separating pad portion includes an upstream end portion and a downstream end portion in the moving direction, and wherein the upstream end portion and the downstream end portion curve so as to protrude toward an upstream side in the moving direction as approaching the central portion in the rotation axis direction from the both end portions in the rotation axis direction.

* * * * *